US010704213B2

(12) United States Patent
Gerhardy et al.

(10) Patent No.: US 10,704,213 B2
(45) Date of Patent: Jul. 7, 2020

(54) METHOD FOR CONTROLLING A HEIGHT ADJUSTMENT OF A STRIPPING PLATE OF A GROUND MILLING MACHINE, AND GROUND MILLING MACHINE

(71) Applicant: BOMAG GMBH, Boppard (DE)

(72) Inventors: Michael Gerhardy, Boppard (DE); Steffen Wachsmann, Boppard (DE); Jens-Martin Zehbe, Boppard (DE)

(73) Assignee: BOMAG GMBH, Boppard (DE)

( * ) Notice: Subject to any disclaimer, the term of this patent is extended or adjusted under 35 U.S.C. 154(b) by 0 days.

(21) Appl. No.: 16/198,999

(22) Filed: Nov. 23, 2018

(65) Prior Publication Data

US 2019/0161924 A1 May 30, 2019

(30) Foreign Application Priority Data

Nov. 24, 2017 (DE) ..... 10 2017 010 919

(51) Int. Cl.

| | |
|---|---|
| ***E01C 23/088*** | (2006.01) |
| ***E01C 23/12*** | (2006.01) |
| *E21C 35/00* | (2006.01) |
| *E21C 25/06* | (2006.01) |

(52) U.S. Cl.

CPC ..... *E01C 23/088* (2013.01); *E01C 23/127* (2013.01); *E01C 2301/00* (2013.01); *E21C 25/06* (2013.01); *E21C 35/00* (2013.01)

(58) Field of Classification Search

CPC ..... E01C 23/088; E01C 23/127

See application file for complete search history.

(56) References Cited

U.S. PATENT DOCUMENTS 5,318,378 A * 6/1994 Lent ..... E01C 23/088 404/75
5,607,205 A * 3/1997 Burdick ..... E01C 19/00 299/1.5
5,879,056 A * 3/1999 Breidenbach ..... E01C 23/088 299/1.5

(Continued)

FOREIGN PATENT DOCUMENTS

DE 102012012607 1/2014
DE 102012018918 3/2014

(Continued)

OTHER PUBLICATIONS

Examination Report from corresponding German Appln. No. 10 2017 010 919.2, dated Jul. 30, 2018.

*Primary Examiner* — Janine M Kreck
(74) *Attorney, Agent, or Firm* — Grossman, Tucker, Perreault & Pfleger, PLLC

(57) ABSTRACT

The present invention relates to a method for controlling a height adjustment of a stripping plate of a ground milling machine, in particular a stripping plate of a cold milling machine, during the working process, said method comprising the following steps of detecting the striking of the stripping plate against an obstacle; automatically triggering the height adjustment unit for lifting the stripping plate from a working position, in which the stripping plate is in contact with the underlying ground to be processed, to avoid a further collision with the obstacle; and automatically triggering the height adjustment unit for lowering the stripping plate back to the working position upon overcoming the obstacle.

20 Claims, 4 Drawing Sheets

(56) References Cited

U.S. PATENT DOCUMENTS

| | | | | |
|---|---|---|---|---|
| 10,378,350 | B2 * | 8/2019 | Berning | E01C 23/088 |
| 2013/0341996 | A1 * | 12/2013 | Franzmann | E01C 23/127 299/1.5 |
| 2016/0186391 | A1 | 6/2016 | Wachsmann | |

FOREIGN PATENT DOCUMENTS

| | | |
|---|---|---|
| DE | 102013015873 | 3/2014 |
| DE | 102012012397 | 4/2014 |
| DE | 102013006105 | 10/2014 |
| DE | 102015002426 | 6/2016 |

* cited by examiner

METHOD FOR CONTROLLING A HEIGHT ADJUSTMENT OF A STRIPPING PLATE OF A GROUND MILLING MACHINE, AND GROUND MILLING MACHINE

FIELD

The invention relates to a method for controlling the height adjustment of a stripping plate of a ground milling machine as well as to a ground milling machine.

BACKGROUND

Ground milling machines, which are employed, for example, for cold milling asphalt surfacing, stabilizing and/or recycling the underlying ground or also for the extraction of natural resources using so-called surface miners, usually comprise, as their essential elements, a machine frame with traveling devices, an operator platform, a drive engine and a milling device. The milling device includes a milling drum which has a rotation axis arranged horizontally and transversely to the working direction of the ground milling machine, and, rotating about its rotation axis, mills off the ground in working operation. The milling drum is usually arranged inside a so-called milling drum box, which is provided with a stripping plate that can be displaced upwards and downwards. In working or milling operation, when displaced downwards, i.e. in its stripping position, the bottom edge of the stripping plate rubs over the milled surface of the milling bed behind the milling drum and, in a position resting on the milling bed, scrapes milled material into the interior of the milling drum box. Provision may additionally be made here for the stripping plate to be actively pressed against the underlying ground from above with the aid of the adjusting device. The position of the stripping position, i.e. the extent to which the stripping plate is displaced downwards, decisively depends on the current milling depth of the ground milling machine. In alternative applications, it is also known to select the stripping position such that the stripping plate is not lowered onto the milling bed but is held at a defined height, usually a few centimeters, to leave a defined amount of milled material on the milling bed. For transport travels and/or for maintenance purposes, it is possible to elevate the stripping plate in vertical direction into a transport position. It is also known to additionally design the stripping plate such that it can be swiveled open, for example from the elevated transport position, for maintenance of the milling drum. Relevant prior art arrangements are described, for example, in DE 10 2013 015 873 A1, DE 10 2015 002 426 A1, DE 10 2012 012 607 A1, DE 10 2012 018 918 A1 and DE 10 2013 006 105 A1. Further, it is known to provide a ground milling machine with sensors for the detection of wear at chisels.

With such ground milling machines, it may happen during the working or milling process that the stripping plate rubbing over the milling bed gets stuck, in the working or milling direction, at edges, small steps, grooves or the like that are present on the underlying ground to be processed and protrude vertically and/or laterally into the area of the milling bed. In the case of such a "getting stuck" event, there is the risk that the stripping plate gets overloaded and a halt of the ground milling machine is initiated or caused, which is not desired or expected by the operator of the ground milling machine. This may even result in damage to the entire machine.

In the prior art, two approaches are known so far for avoiding such a halt due to the stripping plate "getting stuck" at obstacles in or at the underlying ground to be processed. According to a first approach, the driver or operator of the ground milling machine has to recognize the stall of the ground milling machine by himself and then elevate or lift the stripping plate through manual actuation in order to be able to circumvent or travel over the obstacle. Then, once the obstacle, or at least the beginning of the obstacle, has been overcome, the operator has to lower the stripping plate back to the working position, which again needs to be done manually. Since each operator has a different responsiveness and further an experienced milling machine driver is required for this, there may be large differences in the subjective recognition and classification of the obstacle. Damage cannot be avoided reliably. According to a second approach, the lowermost edge of the stripping plate has spring-loaded strips arranged thereon, which when striking against an obstacle in the horizontal direction "deflect inwards" and through their position change send a sensor signal to the machine control. This signal is used to automatically lift the stripping plate and shortly thereafter return it to the initial state, i.e. to the floating position. The contact strips thus act as a type of pushbutton which is essentially activated directly by the obstacle. This variant involves a complex design to provide the spring-loaded strips, which results in high costs. Moreover, this system has a relatively high susceptibility to errors and failure.

SUMMARY

The object of the present invention is thus to provide a cost-efficient and reliable way to control the height adjustment of a stripping plate when the latter gets stuck at ground obstacles during the working process.

To achieve the object, the method according to the invention for controlling a height adjustment of a stripping plate of a ground milling machine, in particular a road cold milling machine, involves the following steps during a working or milling process:

a) indirectly detecting the striking of the stripping plate against an obstacle in a working direction from the working and/or traveling behavior of the ground milling machine with the aid of at least one sensor for detecting an operating variable of the ground milling machine associated with the milling process and a control unit;

b) automatically triggering the height adjustment unit for lifting the stripping plate from a stripping position, in which the stripping plate is in contact with the underlying ground, when a collision with an obstacle has been detected; and, c) subsequently, automatically triggering the height adjustment unit for lowering the stripping plate back to the stripping position.

A first important aspect is thus that the stripping plate is height-adjustable relative to the remaining ground milling machine with the aid of a height adjustment unit. This is per se known in the prior art. For this, it is possible, for example, to use a corresponding hydraulic cylinder for driving the height adjustment unit. In the present context, the position in which the stripping plate is lowered onto the milling bed (or at least onto the milled material) is referred to as the stripping position. The stripping position thus designates the desired lifting position of the stripping plate during the milling process. It is further important to note that the ground milling machine advances in a defined working or milling direction during working operation. This is usually the forward direction.

An essential aspect of the method according to the invention now consists in the fact that the existence of a collision of the stripping plate with a ground obstacle is no longer ascertained directly via factual actuation of a corresponding pushbutton or subjectively via the driver monitoring the machine behavior, but is instead detected indirectly by inferring such an operating situation from the milling and/or traveling behavior of the ground milling machine with the aid of at least one sensor for detecting an operating variable associated with the milling process, in particular, for example, the variation of an operating variable of the ground milling machine per se or the milling drum associated with the milling process. Said operating variable associated with the milling process refers to the characteristics of actual operating variables, i.e. an actual value of such an operating variable of the milling tool or milling drum (working behavior) and/or the traveling operation (traveling behavior). An operating variable associated with the milling process is thus an operating variable that directly or indirectly relates to the milling process, and that is in particular influenced by the milling process and thus at least indirectly depends on the running milling process. This may, on the one hand, concern operating variables regarding the work tool, for example a rotational speed of the milling drum and/or a milling drum torque. These operating variables are hereinafter also referred to as milling drive operating variables. On the other hand, this may also concern other variables relating to the milling process in a broader sense, for example the traveling speed of the ground milling machine, momentums applied to the travel drive, operating characteristics of elements supplying drive power to the travel drive, for example pumps etc. These operating variables are hereinafter also referred to as travel drive operating variables. In this regard, operating variables that are, according to the invention, associated with the milling process will be explained in more detail below. All in all, the invention is thus based on the finding that actual values of operating variables associated with the milling process will change, in particular in a manner characteristic for this process, when the stripping plate strikes against an obstacle. For example, in such a case, there will be an abrupt drop in the advancing speed of the ground milling machine, a decrease in the milling drum torque applied to the milling drum, an increase in the rotational speed of the milling drum, etc. The method according to the invention utilizes this finding of indirectly inferring the event "striking of the stripping plate against an obstacle" from the machine behavior in a manner according to the invention, i.e. by resorting to an operating variable associated with the milling process. Upon detection of such a striking of the stripping plate against an obstacle, the invention subsequently involves automatic, self-acting triggering of the height adjustment unit for lifting the stripping plate from its stripping position, in which the stripping plate is in contact with the underlying ground. This can likewise be done by the control unit. Through this, the stripping plate is released in the working direction with respect to the ground obstacle. However, to obtain the desired stripping result in the end, according to the invention, the triggering of the height adjustment unit for lifting the stripping plate is followed by automatic, self-acting triggering of the height adjustment unit for lowering the stripping plate back to its stripping position, which is in particular also done by the control unit. Through this, the stripping plate thus reassumes its initial operating position. As provision is in particular made for the ground milling machine to be propelled further in the milling direction throughout the method steps presented above, the obstacle acting in the milling direction is normally already traveled over by a single lift of the stripping plate, or the stripping plate is then pressed down onto the obstacle from above, which, however, does not obstruct advancement of the ground milling machine in the milling direction. However, it is also possible to provide for time- and/or distance-delayed lowering here, as will be explained in more detail below.

Through the method according to the invention, the critical working state described above, in which the stripping plate gets stuck at a ground obstacle, can be counteracted in a cost-efficient and reliable manner. According to the invention, a "getting stuck" event, for example at edges or other obstacles present on or at the underlying ground to be processed, is basically detected indirectly from the working and/or traveling behavior of the ground milling machine, whereupon the lifting of the stripping plate is initiated in a self-acting manner based on objective criteria. The subsequent lowering of the stripping plate back to the stripping position after the obstacle has been overcome is likewise performed in a self-acting manner. Manual intervention in and monitoring of this process, including the lowering of the stripping plate by the operator, is superfluous, which makes the method very reliable. Also, the spring-loaded strips at the lowermost edge of the stripping plate, which are used in the prior art and require a complex design, can likewise be dispensed with, which reduces the costs. Another advantage is that ground milling machines which carry out the method according to the invention can be retrofitted with relatively little effort.

The operating variable associated with the milling process is thus in particular an actual value of a travel drive operating variable and/or a milling drive operating variable. Travel drive operating variables may be, for example, a rotational speed of a traveling unit, for example a crawler track, etc. They are in particular travel drive operating variables resulting from the traveling operation, and thus are travel drive operating variables which are a result of travel and/or milling drive specifications defined, for example, by the driver or a control unit in the sense of target values. In the present case, the relevant operating variable associated with the milling process is thus an actual value that is in fact existent in operation and is ascertained in the working process, and that changes depending on a striking of the stripping plate against an obstacle in the working direction.

Various specific alternatives can be resorted to for ascertaining the striking of the stripping plate against an obstacle in the working direction. On the one hand, for example, it is possible to ascertain and monitor the actual movement of the ground milling machine over ground over time, i.e. its variation with time. In this case, the travel drive operating variable is thus in particular an actual and real, respectively, advancing parameter, i.e. an ascertained and monitored actual travel drive operating variable of the ground milling machine relative to the ground. Said actual advancing parameter is thus a real variable that reflects the actual movement of the ground milling machine relative to the external environment of the ground milling machine. Said actual advancing parameter may thus in particular be the actual advancing speed and/or the actual, in particular also negative, acceleration and/or the actual variation in advancing speed and/or acceleration of the ground milling machine relative to the external environment, the rotational speed of a running gear or an operating component associated therewith, etc. Said actual advancing parameter is ideally ascertained via at least one suitable sensor, as will be described in more detail below. Ascertaining the actual travel drive operating variable may thus in particular also involve ascertaining the actual moving behavior of the ground milling machine, basically relative to the external environment of the ground milling machine, for example by referencing the position of the ground milling machine relative to the external environment. When the stripping plate is stuck at a ground obstacle, there is an abrupt drop in traveling speed, i.e. the actual advancing speed. Thus, the monitoring of the real traveling speed, or its variation over time, is utilized here as an indicator for the detection of the triggering event for the lifting of the stripping plate, which is decisive for the method according to the invention. Additionally or alternatively, it is possible here to resort, for example, to the real rotational speed of a running gear, the real pressure and/or volumetric flow rate in a hydraulic travel drive, available real drive torques, etc. Thus, in contrast to monitoring the actual movement of the ground milling machine over ground, the focus is in this case not on the outside but concerns the machine's internal operating variables. This is advantageous in that a reference to the external environment is not required.

This approach can be enhanced further by not only monitoring the variation of the actual travel drive operating variable per se over time but, additionally or alternatively, also comparing said variable, or the movement information of the ground milling machine ascertained in the manner described above, to a theoretical advancement signal or travel drive specification determined internally by the machine via the control unit in the sense of a target value. The essential aspect of this specified travel drive operating variable is that it contains an indication based on currently specified operating functions of the machine as to how the ground milling machine should theoretically be moving in the external environment under the currently existing operating conditions (target value). It thus concerns a theoretical machine movement that is ascertained based on references on the machine side, for example a traveling speed specification defined by the driver, i.e. a specified value. If the specified travel drive operating variable and the actual travel drive operating variable differ from one another, i.e. if the ascertainment of the actual advancement of the ground milling machine shows a halt or at least a significantly slower advancement result compared to the result obtained using the target value, a striking contact between the stripping plate and an obstacle is inferred. This may in particular also involve performing an evaluation, for example a map-based evaluation, and classification by the control unit to enable an even more precise identification of a collision of the stripping plate with the ground obstacle.

For ascertainment of the machine's internal theoretical travel drive operating variable, a first essential aspect consists in obtaining an information in this regard as to how the ground milling machine should be moving with the present specifications. This may, for example, also involve a suitable sensor that ascertains a travel drive operating variable of the drive system of the ground milling machine that varies internally on the machine side in relation to the advancing speed of the ground milling machine as specified by the driver of the ground milling machine. Such a parameter is preferably acquired by retrieving data relevant for movement from a machine control of the ground milling machine, but can also be ascertained by one or more sensors that are independent of the machine control. This refers in particular to data of the machine control that already exist for the regular machine operation, independent of the height adjustment of the stripping plate. Particularly preferred machine-internal travel drive operating variables here include a rotational speed of one or more of the track chain and/or wheel drives, i.e. the traveling devices of the ground milling machine, an electrical operating variable relevant for the propulsion of the ground milling machine, in particular an amperage of magnets that specify or determine the traveling speed, in particular at least one travel-drive pump and/or a swiveling angle (swash plate angle) of the travel-drive pump in case a variable displacement pump is used, and/or the switching position of a lever or joystick, etc.

For ascertainment of the actual travel drive operating variable, in particular the actual advancing speed and/or the actual negative acceleration and/or the actual variation of the advancing speed and/or acceleration of the ground milling machine in the working direction, it is preferred to resort to a real sensor which detects the current speed and/or the acceleration, in particular also the negative acceleration, of the ground milling machine over ground. With the aid of such a sensor, the aforesaid required actual movement values can be acquired particularly easily. Such a real sensor may in particular be a radar sensor (Doppler effect), a laser sensor or an accelerometer. In this regard, it is also possible to provide for mechanical speed scanning over ground, for example using a separate ground-contacting wheel, or to resort to a camera system for the detection of the underlying ground, GPS receivers and/or a total station as a reference.

Provision may additionally be made for the sensor to detect an actual distance traveled by the ground milling machine and/or a real speed and/or slip at the track chains and/or wheels of the ground milling machine as a travel drive operating variable.

To ascertain the actual travel drive operating variable of the ground milling machine, in particular also by specific reference to the external environment as described above, instead of the sensor, use may additionally or alternatively also be made of an internal sensor or components from which a jerky halt of the ground milling machine can be recognized, for example when there is a sudden drop in torque (with the aid of a suitable torque sensor) and the track chains continue to run steadily, i.e. slip occurs. What is essential is that the travel drive operating variable that is utilized varies directly or at least indirectly depending on the actual movement of the ground milling machine in the external environment. Preferred approaches here are, for example, the detection of the torque on the output side of the drive engine, usually a diesel engine, the detection of the torque and/or hydraulic pressure at the travel drives, in particular crawler tracks, the monitoring of the lifting column pressure, in particular at least one of the rear lifting columns in the working direction (an abrupt pressure increase or drop can be ascertained here when the stripping plate gets stuck at a ground obstacle).

In addition or as an alternative to resorting to travel drive operating variables, as described above, within the scope of the invention, it is also possible to resort to milling drive operating variables to detect a striking of the stripping plate against an obstacle. This may, on the one hand, preferably be done by monitoring the variation of an ascertained actual milling drive operating variable over time through the control unit or may, on the other hand, be done by comparing, through the control unit, an ascertained actual milling drive operating variable of the ground milling machine to a milling drive operating variable specified internally by the machine. It is particularly preferred here to resort to the actual rotational speed of the milling drum and/or the torque applied to the milling drum. When the stripping plate of the machine gets stuck at a ground obstacle, the milling process is interrupted and the amount of milled material accumulated inside the milling drum box decreases. Thus, as a result, the resistance counteracting the rotation of the milling drum decreases, so that the rotational speed of the milling drum increases and the milling drum torque decreases. This solution is particularly advantageous in that in this case any direct consideration of the external environment and/or the travel drive itself can be dispensed with, which considerably increases the robustness and sturdiness of the overall system against external influences.

The switch-over of the movement of the stripping plate from lifting the same from its stripping position in the case of an obstacle to the subsequent lowering of the stripping plate back to its stripping position is preferably performed when it is ascertained, in particular with the aid of the aforesaid real sensor, that a defined minimum speed and/or positive acceleration of the ground milling machine over ground in the working direction has been reached. This ensures that the stripping plate has passed the ground obstacle in the working direction and further lifting of the stripping plate is thus no longer required. This switch-over of the lifting movement of the stripping plate is particularly preferably done in a time- and/or distance-shifted manner. This means that the lowering of the stripping plate, which follows the lifting of the stripping plate, is performed in a time- and/or distance-shifted manner to ensure that the ground obstacle has been traveled over by the stripping plate and no further collision with that same obstacle occurs.

The ground obstacles that usually occur are oftentimes relatively small. To keep the amount of milled material left on the milling bed as small as possible when temporarily lifting the stripping plate from its stripping position, provision may be made for the lifting of the stripping plate in step b) to be performed no further than up to a defined threshold value, in particular by a maximum of 10 cm in the vertical upward direction starting from the stripping position, and more particularly by a maximum of 5 cm. If the stop of the machine that occurred during the working process is not overcome by lifting the stripping plate to the admissible extent, there may be some other cause for the interrupted operation. It is therefore additionally preferred that the method according to the invention is interrupted, either in a time-dependent manner, i.e. once a defined time interval has elapsed, and/or depending on the lifting height.

In the method according to the invention, the individual control operations, in particular for displacing the stripping plate upwards and downwards, are preferably performed via a control unit that is connected, on the one hand, to the corresponding sensors and, on the other hand, to the height adjustment unit, i.e. the drive of the height adjustment unit, of the stripping plate. The control unit may in particular also be part of the machine control.

It is further preferred that the intervention of the control, or the detection of a ground obstacle, is indicated on the operator platform, for example via a suitable display screen and/or a control lamp. In this manner, the driver of the ground milling machine can quickly and reliably relate displacing movements of the stripping plate not directly triggered by him to the method according to the invention.

Further provided according to the invention is a ground milling machine, in particular a cold milling machine, comprising a machine frame supported by traveling devices, a drive engine, usually a diesel engine, and a milling device arranged inside a milling drum box, said milling drum box comprising a height-adjustable stripping plate. The ground milling machine further comprises at least one sensor, in particular on the machine frame, via which an actual value of an actual travel drive and/or milling drive operating variable of the ground milling machine is ascertained and monitored. Further provided is a control unit configured for carrying out the method described above.

As already mentioned above, the design according to the invention provides a cost-efficient and reliable solution by which obstacles at which the stripping plate of the milling drum box gets stuck are detected in a self-acting manner independently of the driver of the ground milling machine and the lifting of the stripping plate and a subsequent lowering above or behind the obstacle are carried out reliably and automatically. The solution according to the invention moreover has the advantage that the construction of the stripping plate can be carried out in an optimized manner in terms of function, wear, costs and stability. It is further advantageous that no tactile sensors are required in the dirt area and/or at an exposed position. In addition to the actual obstacle detection feature, the employed sensor may also be used to additionally detect the actual distance traveled, the real speed and, if applicable, also the slip of the track chains or wheels in order to also initiate a corresponding closed-loop control based thereon.

BRIEF DESCRIPTION OF THE DRAWINGS

The invention will be explained in more detail below with reference to embodiment examples shown in the figures. In the schematic figures.

DETAILED DESCRIPTION

Figure 1:
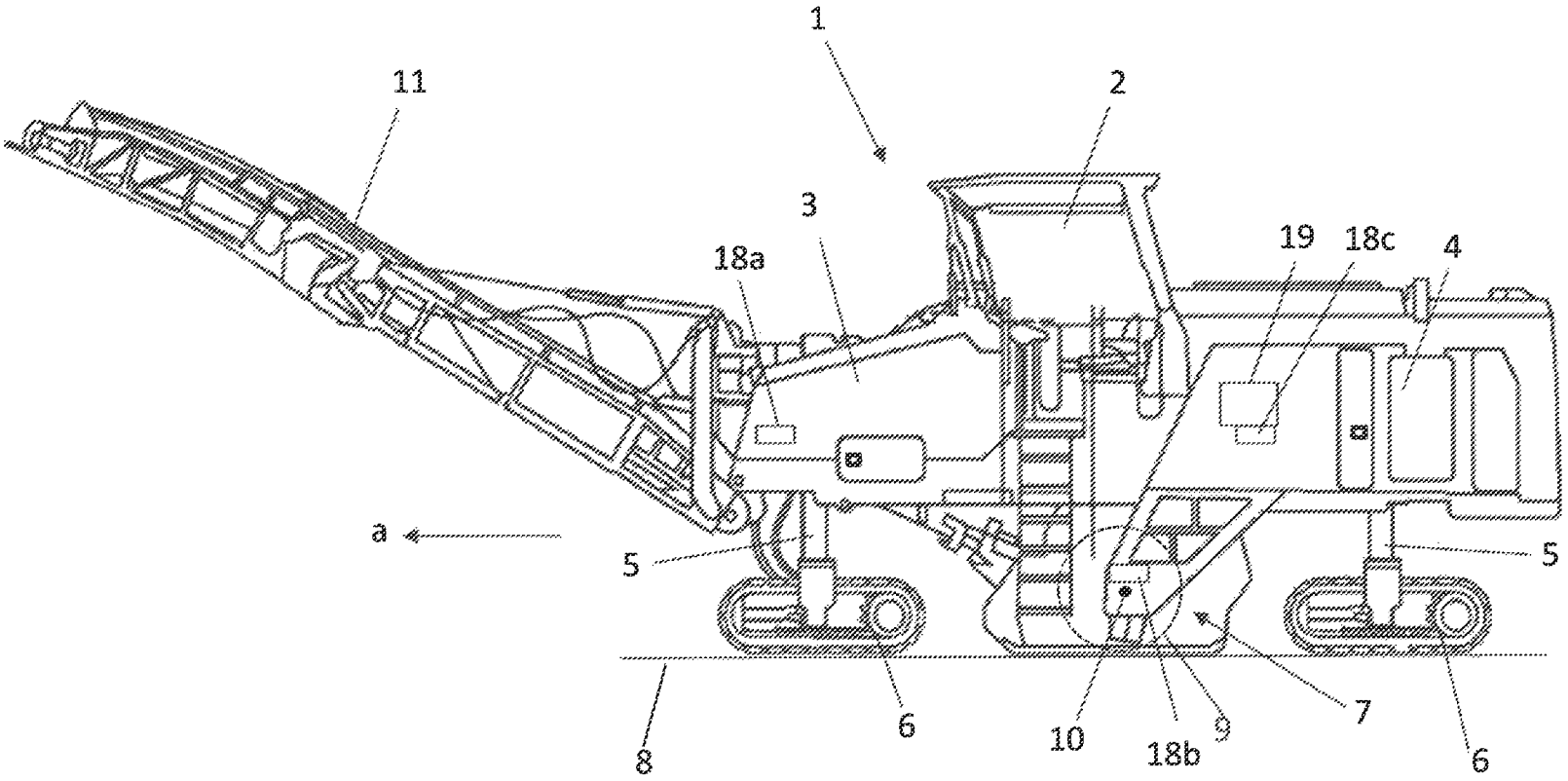
FIG. 1 is a side view of a ground milling machine.

FIG. 1 shows a ground milling machine 1, which is in this case designed as a road or cold milling machine. The ground milling machine 1 has an operator platform 2, a machine frame 3, a drive engine 4 and traveling devices 6 connected to the machine frame 3 via lifting columns, said traveling devices in the present case being crawler tracks, although wheels may be employed as well. In working operation, the ground 8 to be milled off is removed in the working direction a by a milling drum 9 mounted for rotation about a horizontal rotation axis 10 extending transversely to the working direction a inside a milling drum box 7 that is connected to the machine frame 3 and is arranged centrally between the front and rear traveling devices 6. Via a discharge belt 11, milled material is transferred onto a transport vehicle, which is not shown, and is transported away by the latter. The invention similarly also relates in particular to rear rotor milling machines in which the milling drum is arranged in the rear region of the machine, to ground stabilizers, recyclers and surface miners.

The ground milling machine 1 is provided with a sensor 18*a*, which is arranged on the machine frame 3. The position of the sensor 18*a* on the machine frame 3 is in this case shown merely schematically and may be varied according to the circumstances, i.e. depending on the type of ground processing machine used. It should, however, not be arranged in the "dirt area" or at an exposed position. The sensor 18*a* is therefore preferably arranged in particular in front of the milling drum box in the working direction, and in this area in particular at a location vertically below the machine frame 3. The sensor 18*a* may in particular be a radar sensor, a laser sensor, an accelerometer or any other type of sensor suitable for recording the speed or the acceleration, in particular the negative acceleration, of the ground milling machine 1 over ground. Additionally or alternatively, the sensor 18*a* may also be used to ascertain the rotational speed of the traveling devices 6. What is essential is that the sensor 18*a* is used to obtain a signal that directly and indirectly depends on the actual movement of the ground milling machine 1 in the working or milling direction a and varies as a function thereof. The sensor 18*a* thus ascertains an actual travel drive operating variable in the sense of an actual advancing parameter. Further, a sensor 18*b* is provided. Said sensor is arranged and designed such that it ascertains an actual milling drive operating variable. For this, it is positioned such that it ascertains at least one operating variable that depends on the milling process, for example the rotational speed of the milling drum. The ground milling machine 1 finally also comprises a machine control 18*c*. Via said control, target specifications for travel drive operating variables and milling drive operating variables are transmitted from the driver or other components and are processed for controlling the ground milling machine 1.

The ground milling machine 1 further has a control 19 the function of which will be described below in connection with FIG. 2. The sensors 18*a* and/or 18*b* as well as the machine control 18*c* are connected to the control 19 via signal lines, either via a cable connection or via a wireless data transmission link.

Figure 2:
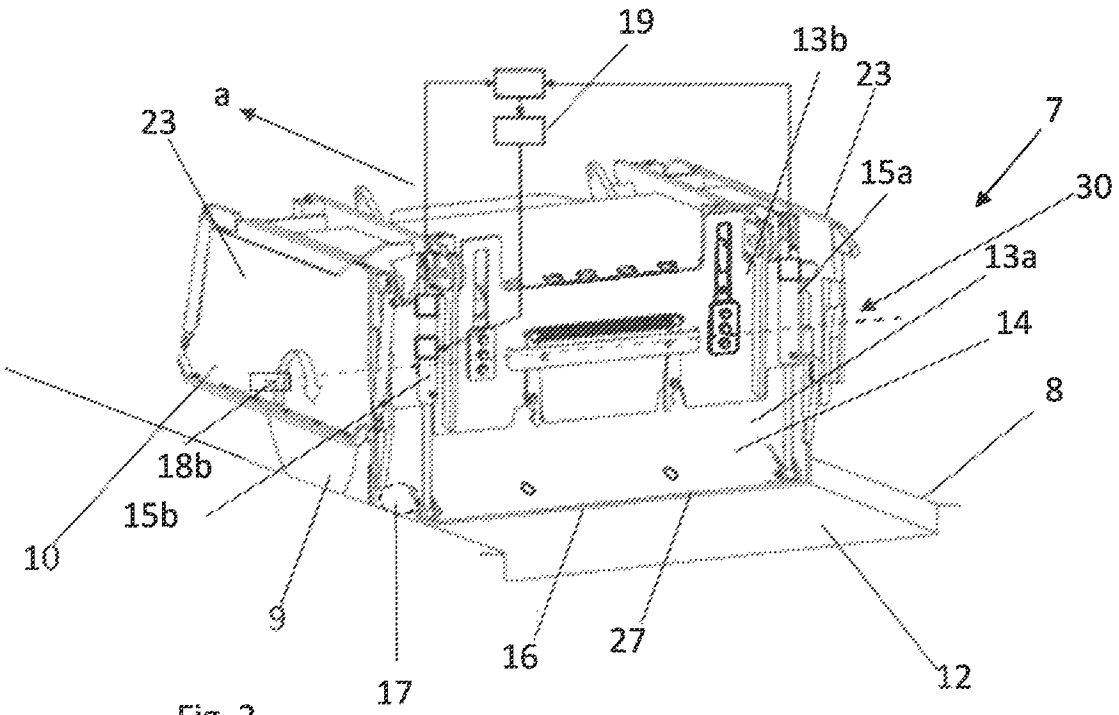
FIG. 2 is an oblique perspective rear view of a milling drum box of the ground milling machine depicted in FIG. 1.

FIG. 2 is an oblique perspective rear view of a milling drum box 7 of the ground milling machine 1 depicted in FIG. 1, which is in this case depicted with the stripping plate 14 lowered to the stripping position during milling operation of the ground milling machine. The stripping plate 14 then contacts the milling bed 12 and scrapes horizontally over the milling bed in the working direction a. The stripping plate 14 can be lifted starting from this position, as will be described in more detail below.

Lateral shields 23 delimit the milling drum box 7 to the two sides that are intersected by the rotation axis 10 of the milling drum 9. Milled material is transported away in the working direction to the front in a known manner. The rear side in the working direction a is essentially formed by the stripping device 30, which comprises a stripping plate 14, a height adjustment device with two actuators 15*a* and 15*b* in the form of hydraulic cylinders 15, and a stripping bar 27.

In the embodiment shown, the stripping plate 14 has a lower plate 13*a* and an upper plate 13*b*. The lower plate 13*a* is mounted at the upper plate 13*b* such that it is longitudinally displaceable, and is shown in the lowered position in FIG. 2. Thus, only the lower part of the stripping plate 14 is height-adjustable in the present embodiment example. However, variants in which the stripping plate is designed as one integral piece and/or is height-adjustable as a whole are explicitly also encompassed by the invention.

During working operation, the ground milling machine 1 mills the ground through rotation of the milling drum 9 using the chisel devices arranged thereon (not shown) and transports the loosened milled material away via the discharge belt 11 (see FIG. 1). A milled track 40 having milling edges 41 and a milling bed 12 is formed in the ground 8, with the depth of the milling bed 12 depending on the set depth of the ground milling machine 1. The stripping device 30 can be displaced using the height adjustment unit 15. The stripping plate 14 is then, for example, guided over the milling bed in the working direction a, scraping directly on the milling bed 12.

If there is a ground obstacle 17 in the milling bed 12, such as an edge, a small step, a groove or the like, a collision of said obstacle 17 with the stripping plate, which is lowered in working operation 14, causes a halt or a delay in movement of the ground milling machine 1 in the working direction a. In other words, the machine is thus stuck in the working direction via the jammed stripping plate 14. This is solved in the manner described below by resorting to at least one of the sensors 18*a* or 18*b* for the detection of an actual travel drive operating variable and/or milling drive operating variable or an actual value and the machine control 18*c*, via which a target value, i.e. a theoretical travel and/or milling drive operating variable is ascertained and monitored, a comparison of which is detected by the control 19 and, if the control 19 detects a collision with an obstacle, by initiating a lifting movement of the stripping plate 14. Alternatively, the obstacle situation may also be detected by the control 19 via the progression of the actual travel and/or milling drive operating variable over time, in this case without resorting to the machine control 18*c*. The essential aspect here is that the control 19 is designed such that it triggers the height adjustment of the two adjusting cylinders 15*a*, 15*b* at the lower plate 13 in a self-acting manner to lift the stripping plate 15 from its working position, in which it is in contact with the ground 8 to be processed, as described above, to resolve the existing collision with the obstacle 17 and thus enable the ground milling machine 1 to continue the milling works in the working direction a. The control 19 is further designed to trigger the height adjustment unit 15*a*, 15*b* in a self-acting manner to subsequently lower the stripping plate 14 back to the working position.

It is noted that the configuration according to the invention is also applicable to other ground processing machines, for example compact milling machines or recyclers and surface miners, as already mentioned. In contrast to the two-piece implementation with an upper plate 13*b* and a lower plate 13*a* as described herein, these may be equipped with a single-piece stripping plate 14, which can be swiveled upwards and downwards in its entirety through a height adjustment unit. When striking against an obstacle 17, the entire stripping plate 14 would then be brought from its working position to a position spaced from the ground 8 by the control 19.

Figure 3:
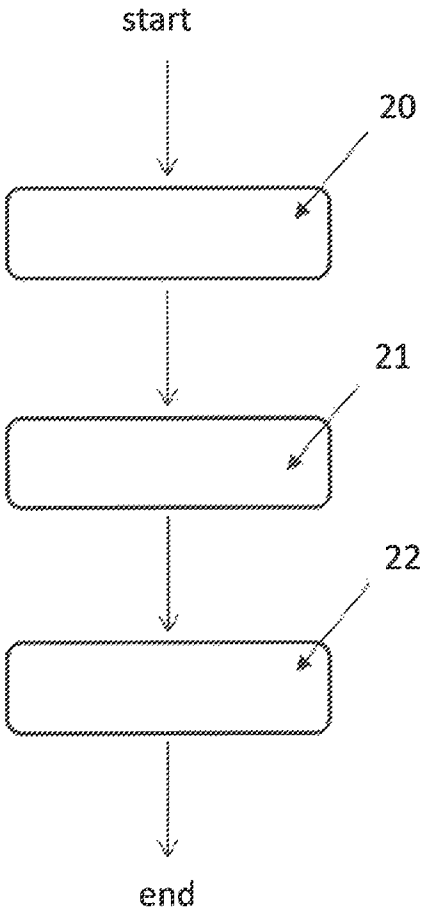
FIG. 3 is a flow chart showing the sequence of the steps of the method for controlling the height adjustment of a stripping plate of a ground milling machine.
Figure 4:
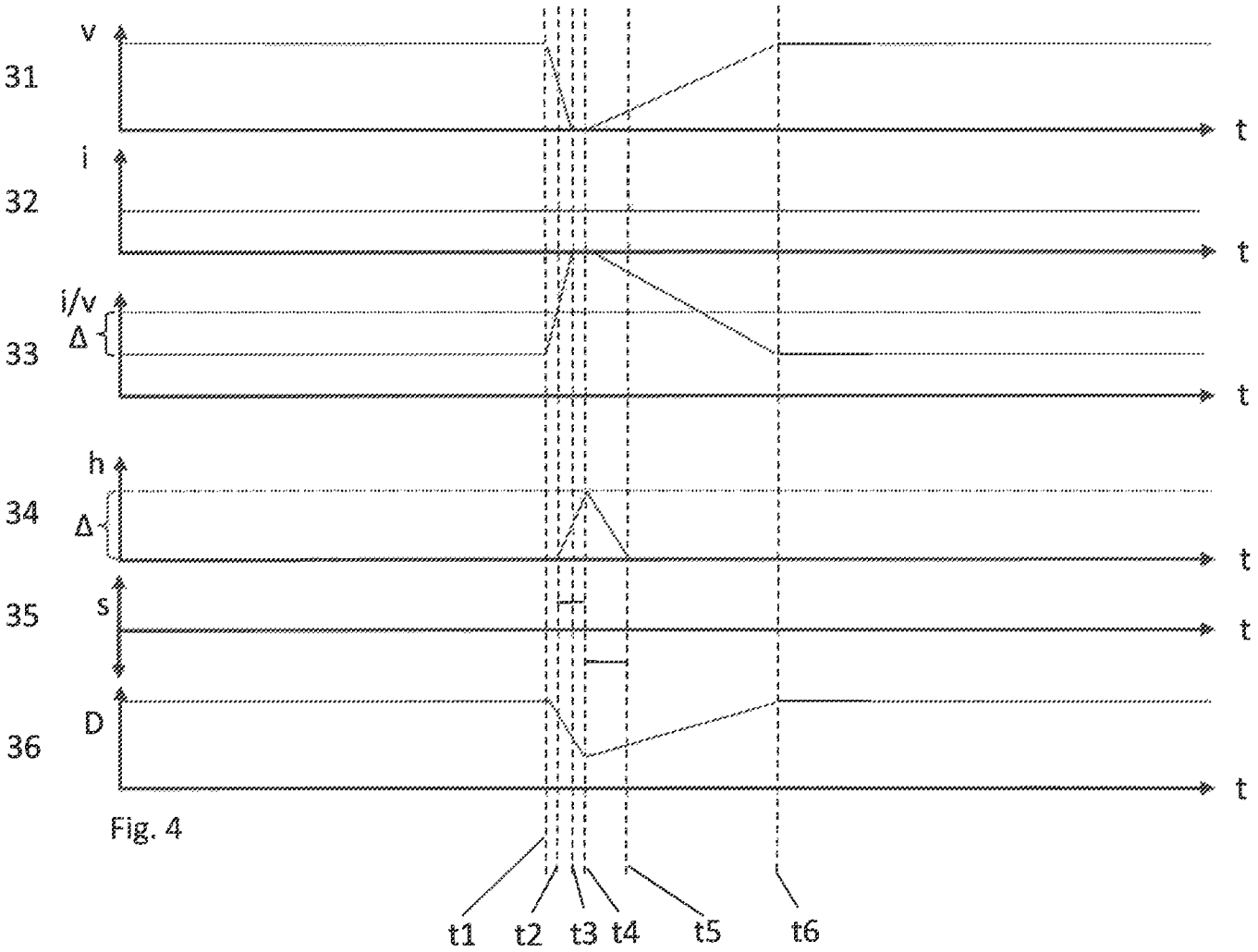
FIG. 4 is a graphic illustration of the relationship between individual operating parameters in the course of the method according to the invention.

FIGS. 3 and 4 now illustrate the essential basic idea of the method according to the invention.

FIG. 3 is a flow chart which illustrates the sequence of the steps of the method for controlling the height adjustment unit 15*a*, 15*b* of a stripping plate 14 of a ground milling machine 1 as shown, for example, in FIG. 1, during the working process of the ground milling machine 1. A first step 20 involves detecting the striking of the stripping plate 14 against an obstacle 17. In a subsequent step 21, the height adjustment unit 15*a*, 15*b* is triggered automatically to lift the stripping plate 14 from a working position, in which the stripping plate 14 is in contact with the ground 8 to be processed, to avoid a further collision with the obstacle 17. Upon overcoming or passing the obstacle 17, a further step 22 of automatically triggering the height adjustment unit 15*a*, 15*b* for lowering the stripping plate 14 back to the working position is finally carried out. The essential aspect here is the detecting in step 20. This is explained in more detail in FIG. 4.

FIG. 4 depicts a number of progressions of travel drive operating variables and milling drive operating variables correlated to one another in a time domain. The abscissa respectively shows a common time axis t. In the uppermost graph 31, the actual advancing speed v (actual value) of the ground milling machine of FIG. 1 in the working direction a in m/s, ascertained, for example, via the sensor 18*a*, is plotted as an example of an actual travel drive operating variable of the ground milling machine 1. In graph 32, on the other hand, the amperage of a current applied to an adjusting magnet of a travel-drive pump is plotted as an example of a target specification of a travel drive operating variable. This target specification thus provides a signal with respect to a travel drive operating variable which depends on how fast, in consideration of the available settings, the ground milling machine should be moving over ground, or at least whether or not it should be accelerating. This signal can, for example, be ascertained or read from the machine control 18*c* directly via a sensor at the adjusting magnet. Alternatively, use can also be made here of the switching position of an operating element, for example a joystick. In other words: The specified travel drive operating variable is thus a specification signal which is acquired at and within the machine and determines the theoretical movement of the ground milling machine in the working or milling direction. In FIG. 4, this value remains constant throughout the complete time period, i.e. the driver has in the present case specified a constant traveling speed. From a machine-internal point of view, the ground milling machine 1 should thus be advancing in the working direction a at essentially constant speed throughout the time period shown in FIG. 4. However, this is not the case, as can be taken from 31. At the time t1, the stripping plate strikes against a ground obstacle, so that the machine is hindered from continuing its movement in the working direction a. This causes the advancing speed, as an example of an actual travel drive operating variable of the ground milling machine 1, to very quickly drop at and beyond the time t2 until the time t3, where the machine comes to a halt.

This halt is ascertained via the control unit by ascertaining the behavior of the two curves 31 and 32 relative to one another, as shown in curve 33. It can be seen that the drop in advancing speed is accompanied by an abrupt increase in the quotient 31/32 starting at the time t1 and continuing beyond the time t2 until t3. At t2, this abrupt variation passes a variation threshold A. This variation threshold achieves a certain inertness of the overall system in order to prevent over-sensitive responsiveness of the control in the case of speed variations of the ground milling machine. Alternatively, it is also possible here to only resort to a variation of the speed progression according to 31 through ascertainment of the speed variation over time. However, simultaneous consideration of the target value from 32 enables the present collision event to be correlated more accurately.

Curve 34 represents the lifting position of the stripping plate, i.e. the distance of the bottom edge of the stripping plate from the milling bed in the vertical direction. At the zero line of the abscissa, the stripping plate is thus in its stripping position. If the variation threshold is exceeded at the time t2, the control initiates a lifting of the stripping plate, which is performed until the time t4 is reached. For this, the control unit actuates the lifting cylinder(s) for height adjustment of the stripping plate, as indicated in curve 35. S here designates a control signal for a lifting movement (above the abscissa) and a lowering movement (below the abscissa).

At the time t4, the ground milling machine 1 thus accelerates again, as can be seen from curve 31. This acceleration in the working direction a is interpreted by the control unit as a sign indicating that the stripping plate has overcome the obstacle at least in the vertical direction, i.e. the stripping plate has been lifted far enough. The control unit thus stops the lifting movement and, according to curve 35, switches over to lowering the stripping plate until, at the time t5, the stripping plate has returned to its initial position and thus rubs over the milling bed again.

Finally, at the time t6, the ground milling machine has regained an actual advancing speed the machine should travel at according to the machine-internal specification.

Curve 36 illustrates utilization of an actual milling drive operating variable, more specifically the torque applied to the milling drum, which may, for example, be ascertained via the sensor 18*b*. Said torque drops at the time t1 as the ground resistance counteracting the milling drum during the milling process decreases due to the halt of the ground milling machine. Alternatively, the rotational speed of the milling drum could be used as an actual milling drive operating variable as well, in which case the progression of the curve would be exactly inverted. The rotational speed of the milling drum increases in the case of a halt of the machine at the ground obstacle.

What is claimed is:

1. A method to control height adjustment of a stripping plate of a ground milling machine during a milling process, the method comprising the following steps:

a) indirectly detecting a collision of the stripping plate with an obstacle in a working direction from a working behavior and/or a traveling behavior of the ground milling machine with at least one sensor to detect an operating variable of the ground milling machine associated with the milling process and a control unit;

b) automatically triggering a height adjustment unit to lift the stripping plate from a working position, in which the stripping plate is in contact with underlying ground, when the collision with the obstacle has been detected; and c) subsequently, automatically triggering the height adjustment unit to lower the stripping plate back to the working position.

2. The method according to claim 1, wherein the operating variable associated with the milling process comprises a travel drive operating variable and/or a milling drive operating variable of the ground milling machine.

3. The method according to claim 1, wherein step a) comprises at least one of the following features:

the control unit monitors variation of an ascertained actual travel drive operating variable over time;

the control unit compares an ascertained actual travel drive operating variable of the ground milling machine to a travel drive operating variable specified internally by the machine;

the control unit monitors variation of an ascertained actual milling drive operating variable;

the control unit compares an ascertained actual milling drive operating variable of the ground milling machine to a milling drive operating variable specified internally by the machine.

4. The method according to claim 3, wherein the ascertained actual travel drive operating variable comprises an actual speed and/or an actual acceleration and/or a variation of the actual speed and/or a variation of the actual acceleration of the ground milling machine relative to an external environment.

5. The method according to claim 3, wherein the travel drive operating variable specified internally by the machine and/or the milling drive operating variable specified internally by the machine is retrieved from a machine control of the ground milling machine.

6. The method according to claim 3, wherein the ascertained actual travel drive operating variable comprises a rotational speed of a track chain and/or a rotational speed of a wheel drive and/or an electrical operating variable and/or a swiveling angle of a travel-drive pump.

7. The method according to claim 3, wherein the ascertained actual milling drive operating variable comprises an actual rotational speed of a milling drum and/or an actual torque of a milling drum.

8. The method according to claim 3, wherein the milling drive operating variable ascertained specified internally by the machine comprises a target rotational speed of a milling drum and/or a target torque of a milling drum.

9. The method according to claim 1, wherein the at least one sensor detects speed and/or acceleration of the ground milling machine over ground.

10. The method according to claim 1, wherein the at least one sensor comprises at least one of a radar sensor, a laser sensor or an accelerometer.

11. The method according to claim 1, wherein the operating variable associated with the milling process comprises an actual distance traveled by the ground milling machine, and/or a an actual speed and/or a slip at a track chain and/or a wheel of the ground milling machine.

12. The method according to claim 1, wherein a switchover from step b) to step c), in a time- and/or distance-shifted manner, is performed when it is ascertained, with the at least one sensor, that a defined minimum speed and/or a defined positive acceleration of the ground milling machine over ground in the working direction has been reached.

13. The method according to claim 1, wherein in step b) the stripping plate is lifted no further than up to a defined threshold value.

14. The method according to claim 2, wherein the operating variable associated with the milling process comprises the travel drive operating variable of the ground milling machine.

15. The method according to claim 2, wherein the operating variable associated with the milling process comprises the milling drive operating variable of the ground milling machine.

16. The method according to claim 6, wherein the electrical variable is an amperage.

17. The method according to claim 10, wherein the at least one sensor comprises at least the radar sensor.

18. The method according to claim 10, wherein the at least one sensor comprises at least the laser sensor.

19. The method according to claim 10, wherein the at least one sensor comprises at least the accelerometer.

20. The method according to claim 1, wherein the ground milling machine is a cold milling machine.

* * * * *